United States Patent [19]

Kempf

[11] 3,949,181

[45] Apr. 6, 1976

[54] LOW PROFILE-LOW BOUNCE ELECTRICAL SWITCH APPARATUS

[76] Inventor: Dean R. Kempf, 714 Heinel Drive, Roseville, Minn. 55113

[22] Filed: Sept. 3, 1974

[21] Appl. No.: 502,959

[52] U.S. Cl. ..... 200/159 R; 200/241

[51] Int. Cl.[2] ..... H01H 1/18

[58] Field of Search ..... 200/159 R, 159 A, 164 R, 200/241, 245

[56] References Cited

UNITED STATES PATENTS

| | | | |
|---|---|---|---|
| 421,340 | 2/1890 | Wollensak | 200/159 A |
| 580,092 | 4/1897 | Moore | 200/159 A |
| 996,303 | 6/1911 | Wilhelm | 200/159 A |
| 3,433,914 | 3/1969 | Ericsson | 200/159 A |
| 3,564,180 | 2/1971 | Lyvang | 200/283 X |
| 3,860,776 | 1/1975 | Lockard | 200/276 |

*Primary Examiner*—James R. Scott
*Assistant Examiner*—William J. Smith
*Attorney, Agent, or Firm*—Cushman, Darby & Cushman

[57] ABSTRACT

Extremely low bounce switching characteristics are achieved by biasing electrical switch conductors with a torsion beam member. The torsion beam member includes a torsion beam portion having an axis which is restrained from rotation thereabout at a first point and an operating beam portion connected to the torsion beam portion at a second point spaced from the first point. The axis of the operating beam is oriented at an angle with respect to the axis of the torsion beam such that displacement of the operating beam causes rotation of the torsion beam from a quiescent rotational state thus producing a torsional bias force against such displacement. At least one of the switch's electrical make/break conductors is operatively associated with the operating beam for displacement therewith while the remaining electrical conductor is disposed for making or breaking the electrical contact upon displacement of the operating beam. A special preferred embodiment includes complementary shaped mating unitary electrical conductors which are shaped so as to constitute both the torsion beam member and the electrical contact member of the switch. This preferred embodiment results in a very low physical profile and low bounce switch which has dual self-wiping electrical contacts and which is simply formed from only two unitary electrical conductors and two molded plastic members.

46 Claims, 8 Drawing Figures

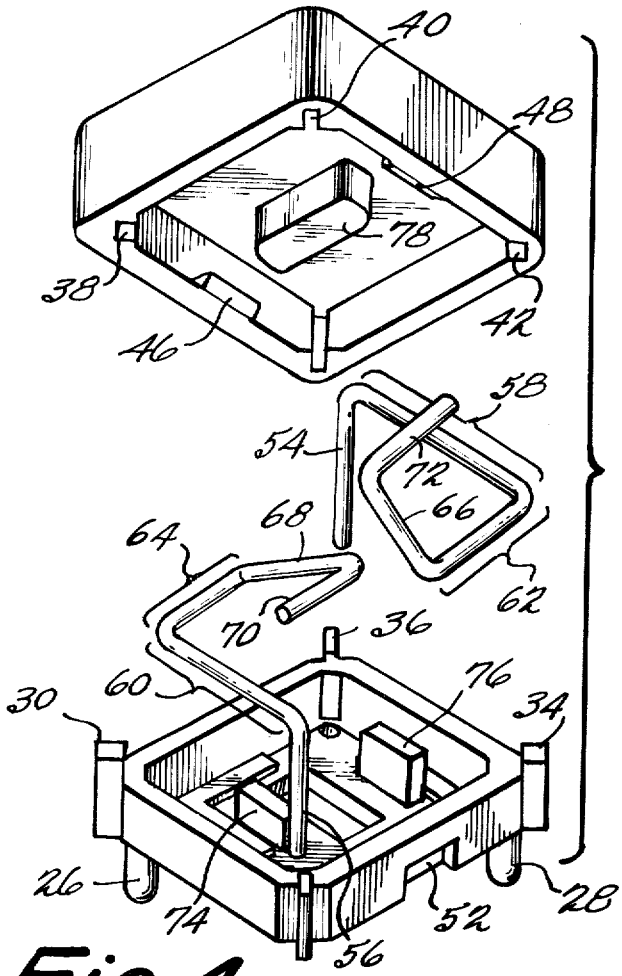
Fig. 4
Fig. 8
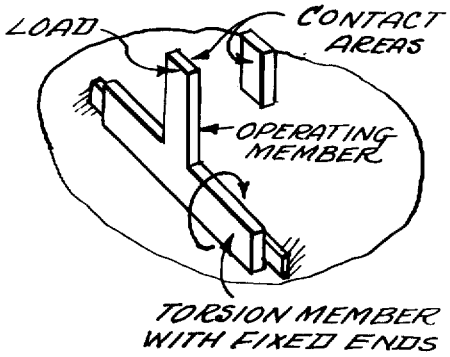
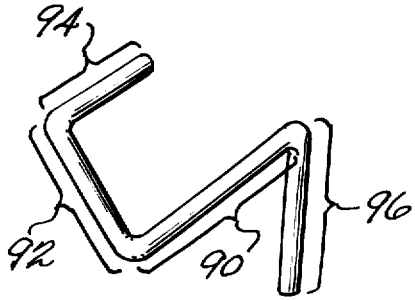
Fig. 7
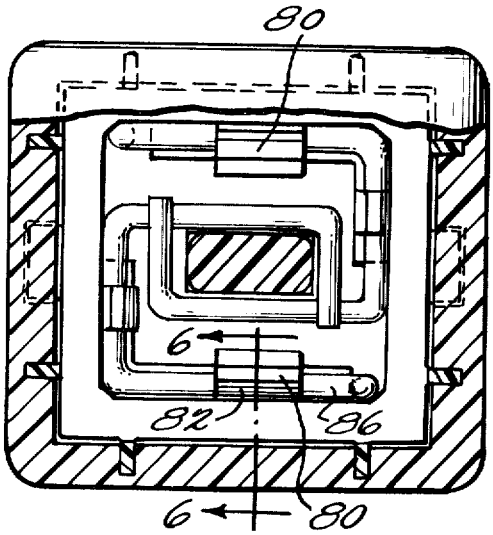
Fig. 5
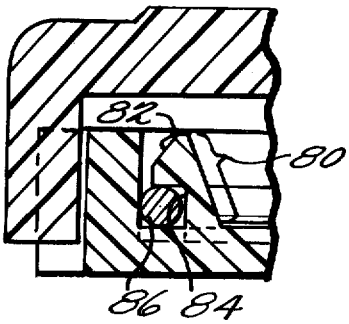
Fig. 6

LOW PROFILE-LOW BOUNCE ELECTRICAL SWITCH APPARATUS

This invention relates generally to apparatus for making or breaking electrical contact in an electrical circuit. More particularly, it relates to a switch contact structure which exhibits a nearly zero bounce switching characteristic. In addition, the unique form of the electrical contacts in the preferred embodiment provides an overall push-activated switch construction having a very low profile while at the same time providing dual contact areas which come into wiping contact with each other for low contact resistance and self-cleaning characteristics.

As will be appreciated by those in the art, there has long been a need for electrical switch contacts having minimum bounce characteristics. For instance, push-activated electrical switches are often used in keyboard arrangements for activating highly sensitive integrated circuit digital electronics circuits. Sincee such circuits are quite sensitive to rapid activation, it is important that switches used to control these circuits have minimum bounce characteristics so as to insure clean-cut and decisive switching control of such logic circuits.

Typically, the push-activated keyboard switches presently in commercial use exhibit a rather undesirably high bounce characteristic which endures for as long as 20–30 milliseconds. In vivid contrast to such bounce characteristics as are exhibited by these existing switches, the newly discovered switch apparatus described herein exhibits a bounce characteristic that has been measured electronically to persist for no more than approximately one microsecond or less. As should be appreciated, this constitutes a rather remarkable improvement of over four orders of magnitude in the bounce characteristics.

At the same time, it is often desirable and sometimes even necessary to provide a switch construction having a low physical profile. The special electrical contact structure of this invention which produces the desirable low bounce switching characteristics also facilitates the achievement of a very low profile switch structure. For instance, the exemplary embodiment to be described below has a total profile thickness of only approximately 3/16 of an inch. Furthermore, all of these advantageous features are accomplished in the preferred exemplary embodiment at the same time that dual electrical contact areas are provided, each of which includes a wiping contact action for low contact electrical resistance and self-cleaning features.

The preferred exemplary embodiment of the invention to be described below comprises a push-activated switch such as may be conveniently utilized in a keyboard arrangement for providing extremely low bounce momentary contact switching operations. However, as those in the art will appreciate after reading the following description of the preferred exemplary embodiment, the preferred embodiment could be readily modified so as to provide a normally closed momentarily opened switch contact structure. Furthermore, while the preferred exemplary embodiment of this invention as described below is manually push-activated, it will be apparent to those in the art that the push-activation could be by other than manual means such as, for instance, the pushing or pulling action provided by an electrical solenoid or relay mechanism.

It is presently believed that the improved switching apparatus of this invention exhibits its nearly zero bounce characteristic primarily because a torsion beam member is utilized to produce a torsional bias force against switch activation. In particular, in the preferred exemplary embodiment, the torsion beam member itself comprises a part of the electrical switch contacts. Since the "spring" biasing force of the switch is produced from rotation of the torsion beam about its axis, this "spring" force is believed to be substantially self-damping thus significantly limiting the mechanical bounce characteristic of the switch and hence the electrical bounce characteristic of the switch. It is also appreciated that a torsion beam provides an increased spring factor per unit mass and this may also have some advantageous effect on the switch operation. In any event, whatever the underlying reason, it has been discovered that a switch structure employing a torsion beam according to this invention offers very real advantages and improvement over the presently used switch structures as noted.

It is believed that this is the first use of such a torsion beam member (as opposed to springs, flat or otherwise) in the positional biasing of electrical switch contacts such as found in electrical switches, relays, etc. By using such a torsion member according to this invention, the "spring" load is effectively taken by the torsion member rather than by an operating member of the electrical contact system thus significantly improving the electrical bounce characteristic of the electrical contacts of the switch structure.

In accordance with this invention, the electrical switch contacts themselves may take many different forms as long as there is a torsion beam member disposed at an effective angle (preferably a right angle) to an operating or electrical contact member such that the torsion member has the greatest effect of taking the spring load for the switch. The torsion member and/or electrical contact structure may be formed from many different types of materials and may take on many different physical shapes (i.e. round wire, square wire, flat stamped metal, cast metal, molded metal, machined metal or a plastic formation having an electrical conductor attached or otherwise operatively associated therewith, etc.). In addition, the movable electrical contacts of this invention may be singly used against a fixed contact or in pairs or in combinations against each other (as will be described in the preferred exemplary embodiment) or multiplied for multi-pole units.

These and other objects and advantages of the invention will be more completely appreciated by reading the following detailed description of the invention taken together with the accompanying drawings, of which:

FIG. 4 is an exploded perspective view of the exemplary embodiment shown in FIGS. 1–3 and illustrating the assembly of the exemplary switch components;

FIG. 5 is a partially cutaway top view of another exemplary embodiment having a preferred guide means;

FIG. 6 is a partial cross sectional view of the exemplary embodiment shown in FIG. 5;

FIG. 7 is a pictorial view of an alternate form for the integral electrical conductors torsion beam members used in the exemplary embodiments of FIGS. 1–6; and FIG. 8 is a pictorial view of yet another exemplary embodiment of the invention.

Figure 1:
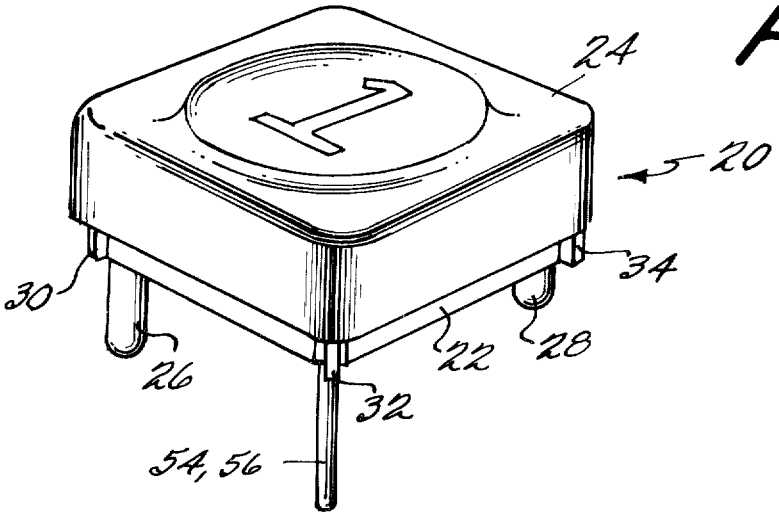
FIG. 1 is a perspective view of an assembled exemplary embodiment of this invention.

The switch 20 shown in FIGS. 1–4 comprises a lower base member 22 and an upper activation member 24. In this exemplary embodiment, the base member 22 is designed for stationary attachment (e.g. to a panel member) via integrally formed mounting lugs 26, 28 and the switch is activated by manually or otherwise pushing the activation member 24 downwardly (i.e. towards the base member). Both the base member 22 and the activation member 24 are provided with mating guide means so as to permit relative to-and-from movement of the base and activation members. As shown in FIGS. 1–4, such guide means comprises not only the mating side walls of the base member 22 and activation member 24 but also the projecting vertical corner tabs 30, 32, 34 and 36 in the base member 22 and the mating slot-shaped corner recesses 38, 40, 42 and 44 in the activation member 24. As should be noted, the mating tabs 30, 34 and slots 38, 42 are of greater width dimensions than the complementary tabs 32, 36 and mating slots 40, 44 thus insuring that the activation member 24 is properly orientated with respect to the base member 22 during assembly of the switch components.

The base member 22 and activation member 24 are preferably fabricated by conventional molding from an electrically insulating plastic material. As will be appreciated, in the exemplary embodiment shown in FIGS. 1–4, the base member 22 comprises a bottom wall and a plurality of side walls extending upwardly around the periphery of the bottom wall. The vertical tabs 30–36 are molded in the outer surface of these side walls and, in particular, at the corners of the side walls as shown in the exemplary embodiment. Similarly, the activation member 24 comprises a top wall and a plurality of side walls extending downwardly from the periphery of the top wall. The side walls of the activation member extend down about the outside of the corresponding sidewalls of the base member, when in the assembled condition, and the vertical slots 38–44 disposed at the inside corners of the activation member are adapted to cooperate with the tabs of the base member to constitute a guide means for maintaining alignment of the base and activation members during relative movement therebetween.

The exemplary embodiment shown in FIGS. 1–4 also includes a mating catch means formed directly in the base member 22 and activation member 24 for limiting the relative movement therebetween to a maximum amount. For example, this may be best seen in FIG. 4 where the activation member 24 includes wedge-shaped catches 46, 48 at the lower inside edge of opposite side walls. In the assembled condition, these catches 46, 48 mate with recesses 50, 52 respectively on the lower outside surface of the two corresponding opposite side walls of the base member 22. Accordingly, when the base member 22 and activation member 24 are in the assembled condition there will be a maximum limit (shown in FIGS. 1–3) to which the activation member can move in a direction away from the base member. At this maximum limit, the upper ledge of the wedge-shaped catches 46, 48 is stopped against the upper end of the recesses 50, 52 thus prohibiting any further movement without deformation of the base and/or activation members.

In the preferred exemplary embodiment, the base and activation members are molded from a plastic material having sufficient resiliency so as to permit easy switch assembly by merely properly orientating the activation member 24 above the base member 22 and pressing the two members together into an assembled state. During this pressing operation, the wedge-shaped catches 46, 48 will help push the opposite side walls of the activation member 24 apart while at the same time compressing the corresponding side walls of the base member 22 thus permitting these two members to be forceably slid over one another until the catch members 46, 48 are properly situated within their mating recesses 50, 52 as should now be apparent. As should also be apparent, the internal dimensions of the side walls and the vertical guide means in the activation member 24 are sized sufficiently larger than the outside dimensions of the mating side walls and guide means in the base member 22 so as to permit substantially unimpeded vertical relative motion (within the maximum permitted limits) between the base member 22 and the activation member 24 in the assembled state of the members.

The mounting lugs 26, 28 are, in the preferred embodiment, formed during the same molding operation in which the base member 22 is formed. The switch may then be mounted to any desired electronic equipment by placing the mounting lugs 26, 28 through mating mounting holes in a panel or the like and then deforming the ends of the mounting lugs 26, 28 on the opposite side of the panel through heat, pressure, etc.

Figure 2:
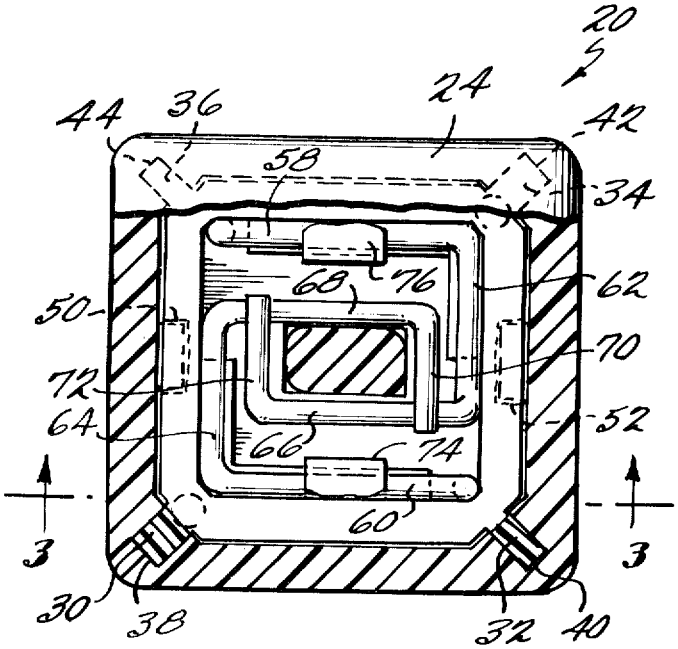
FIG. 2 is a partially cutaway top view of the exemplary embodiment shown in FIG. 1.

In the preferred exemplary embodiment, the electrical switch contacts each comprise an integral electrical conductor which is formed so as to provide external connection leads 54, 56 for connection to an external electrical circuit. The electrical contacts are also shaped so as to respectively provide secured leg portions 58, 60; torsion beam leg portions 62, 64; combined operating and electrical contact legs 66, 68 and further electrical contact legs 70, 72 as best seen in FIG. 4. When in the assembled condition, the connector legs 54, 56 extend through the base member 22 at the inside corners opposite vertical guide means 32, 36 as shown in FIGS. 1–4. The secured leg portions 58, 60 are fixedly secured to the base member 22 in the assembled condition. For instance, as best seen in FIG. 2, the securing means within the base member 22 of the FIG. 1–4 exemplary embodiment comprises blocks of plastic material 74, 76 which are deformed such as through heat, pressure, etc., over the secured leg portions 58, 60 respectively.

The torsion beam leg portions 62, 64 are disposed at an effective angle (preferably 90°) with respect to the respectively associated secured leg portions. Accordingly, the end of the torsion beam leg portion connected to the secured leg is effectively restrained at that point from rotation about the axis of the torsion beam.

Figure 3:
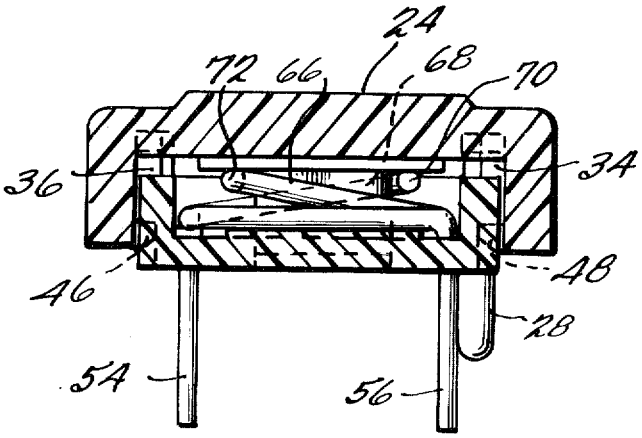
FIG. 3 is a cross sectional view of the exemplary embodiment shown in FIGS. 1 and 2.

The operating legs 66, 68 are connected to an effective angle with respect to the other end of the torsion beam legs 62, 64 respectively. Preferably, the effective angle is 90°. As best seen in FIGS. 3 and 4, the operating legs 66, 68 are also formed so as to extend at an upward angle with respect to the secured leg portions 58, 60 respectively in their quiescent state. As should now be appreciated, displacement of the operating legs 66, 68 will cause a torsional twisting of the torsion beams 62, 64 respectively about their axes. This will, of course, give rise to a torsional spring force tending to return the operating members 66, 68 to their normal or quiescent upwardly inclinded position with respect to the secured legs 58, 60.

In the preferred exemplary embodiment, there is yet another contact leg portion 70, 72 disposed generally parallel to the torsional legs 62, 64 respectively. As will be explained in more detail, in this preferred exemplary embodiment, the operating member 66, 68 also effectively comprise at least part of the electrical contact members which cooperate with the opposite legs 72, 70 respectively to form dual electrical contact surfaces for making or breaking electrical contact within the switch and, accordingly, in an external electrical circuit connected to the connection leads 54, 56.

When the switch is in its assembled state as seen in FIGS. 2 and 3, it should now be appreciated that the torsional spring forces generated by torsion beams 62, 64 and operating members 66, 68 will bias the activation member 24 to its uppermost position. In this position, there is no electrical contact between the two unitary electrical conductors since, as may be best seen in FIG. 3, the contact leg portions 70, 72 of each conductor is disposed at a distance above the operating leg portions 66, 68 respectively of its opposite and complementary conductor. However, as the activation member 24 is depressed, it should now be appreciated that the operating members of the two conductors will be displaced downwardly, thus forcing the contact leg 70 downward into sliding or wiping electrical contact with the operating member or leg 66. At the same time, the contact leg 72 will be forced downwardly into wiping or sliding electrical contact with the operation leg 68. Accordingly, as should now be appreciated, the legs 66 and 68 are actually both operating members and part of the electrical contact members in the exemplary embodiment. In this manner, dual electrical contacts are formed between the two unitary electrical conductors and both such contacts comprise a sliding or wiping type of contact thus producing desirable low contact resistance and self-cleaning features as should now be apparent.

An internally directed projection 78 is provided depending from the top wall of the activation member 24. A mating recess or hole is centrally located in the bottom wall of the base member 22 as may be seen best in FIG. 4. This internally directed projection is disposed between the operating legs and contact legs of the electrical conductors just described so as to maintain a correct alignment of these moving elements.

As should now be apparent, the spring load of the switch just described is effectively taken by the torsion beam member rather than by the operating member of the contact system. This is believed to effectively help damp out any bounce between the contacts. It should also be apparent that the contacts themselves may take on many different forms so long as there is a torsion member at an effective angle (preferably 90°) to an operating and/or contact member such that the torsion member has the greatest effect of taking the spring load. Furthermore, the contacts themselves may be made of many different materials as previously mentioned and take many different shapes, i.e., round wire, square wire, flat stamped metal, cast metal, molded metal, machined metal or plastic with contact point inserted. Although the exemplary embodiment shown in FIGS. 1–4 includes two similarly shaped unitary electrical conductors comprising the torsion beam, operating member, electrical contact, etc., it is contemplated that a single torsion beam, operating member element might be used in combination with a fixed electrical contact as should now be appreciated. Furthermore, it should also be appreciated that the electrical switch of this invention might be used in pairs or combinations and/or multiplied for multi-poled units.

Of course, the unitary electrical conductor used in the exemplary embodiment must possess not only electrical conductivity but sufficient mechanical strength to provide the requisite torsional forces. As a non-limiting, solely exemplary example, it is noted that successful operation has been attained with 0.016 inch diameter phosphor bronze grade A full temper wire having an ASTM B 159 alloy A, or FED QQ-W-401. An acceptable finish on this wire is, for example, 0.000030/0.000050 low stress nickel under 0.000010/000020 gold. The stress was relieved after forming using time and temperature treatment suggested by the wire manufacturer's specifications. All bends were made at a 0.010 inch maximum radius. After the stress had been relieved, this exemplary non-limiting embodiment had a contact leg length of 0.17 inch, an operating leg length of 0.26 inch, a torsion beam leg length of 0.21 inch, a secured leg portion length of 0.315 inch, and a connection leg length of 0.21 inch. All bends were substantially 90° as shown in the FIGURES. In addition, the normal or quiescent orientation of the operating leg with respect to the secured leg comprises an angle of approximately 25° while the contact leg was slightly angled downwardly by 5° toward the plane defined by the torsion beam leg and secured leg portions of the electrical conductor.

The modified exemplary embodiment shown in FIGS. 5 and 6 is substantially similar to the embodiment previously discussed except for the particular type of vertical guide means and wire securement means. For instance, as seen in FIG. 5, the vertical guide means of this embodiment comprise pairs of mating projections and recesses on each side wall of the base member and activation member respectively. This particular embodiment of guide means is believed to be easier to mold and thus, in some respects, preferable to the particular guide means shown in FIGS. 1–4. However, as should be appreciated, the operating of FIG. 5 embodiment with respect to this modified vertical guide means is substantially similar to that already discussed with respect to FIGS. 1–4.

The modified embodiment of wire securement means is best seen in FIG. 6. Instead of the blocks of plastic material 74, 76 which were swaged over the wire securement legs in the embodiment of FIGS. 1–4, the embodiment of FIGS. 5–6 includes a resilient catch member 80 which includes an upper wedge-shaped portion 82 and a lower wire retaining chamber 84. During assembly, the wire securement leg 86 shown in FIG. 6 is forced downwardly past the wedge-shaped area 82 which helps to temporarily deflect the catch member 80 away from the side wall of the base member. After the wire 86 has passed by the widest portion of the catch means 80, it is then received within the chamber 84 and maintained there when the resilient catch means 80 returns to its normal condition as shown in FIG. 6. As should be appreciated, this permits assembly of the entire switch by purely manual manipulation of its four separate parts.

The exemplary embodiments discussed in FIGS. 1–6 include a separate securing leg and external connection leg. However, as shown in FIG. 7, the securing leg and connection leg may, in fact, comprise one and the same leg. For instance, the wire structure shown in FIG. 7 comprises a torsion beam leg 90; an operating/contact member 92; a contact member 94 and a combined securing and connection leg 96. The operation of the legs 90, 92 and 94 are the same as their respective counterparts in the earlier discussed embodiments. Leg 96, however, comprises the functions of both the secured leg portion and the connection leg in that it depends downwardly through the base member for electrical connection. At the same time, the fact that it passes through the base member also effectively secures this leg thereto thus effectively restraining the connected end of the torsion leg from rotation at that point and thus serving the same function as the separate secured leg portion in the earlier discussed embodiments. Accordingly, in the embodiment shown in FIG. 7, leg 96 is itself also a secured leg portion.

Still another embodiment of this invention is shown in FIG. 8. Here, the torsion member of the switch is shown with both ends restrained from rotation. An inverted T shaped member has been secured as shown in FIG. 8 to the torsion beam member such that a load applied to the leg of the structure operates to twist the torsion member and thus give rise to a torsion spring force tending to return the operating member to its quiescent position. An electrical contact would then be made between a contact area at the upper portion of the operating member and a fixed mating contact area as shown in FIG. 8. Of course, if the operating member itself is an electrical conductor, it may comprise one of these contact areas.

Although only a few specific exemplary embodiments of this invention have been described in detail above, those in the art will appreciate that many variations, modification, and/or changes may be made in the exemplary embodiments without in any way departing from the novel and advantageous features of this invention. Accordingly, all such variations, modifications, changes, etc., are intended to be included within the scope of this invention as defined in the appended claims.

What is claimed is:

1. Apparatus for making or breaking electrical contact with low bounce switching characteristics in an electrical circuit, said apparatus comprising:

a first electrical conductor, a second electrical conductor, at least one torsion beam member comprising:

a torsion beam having an axis and being restrained from rotation thereabout at a first point, and an operating beam connected to the torsion beam at a second point spaced from said first point and having an axis oriented at an angle with respect to the axis of said torsion beam such that displacement of said operating beam causes rotation of said torsion beam from its quiescent rotational state thus producing a torsional bias force against said displacement, at least one of said conductors being operatively associated with said operating beam for displacement therewith, the remaining electrical conductor being disposed for making or breaking of said electrical contact with said one conductor upon displacement of said operating beam, and means for displacing said operating beam thereby making or breaking said electrical contact.

2. Apparatus as in claim 1 wherein said at least one conductor and said at least one torsion beam member comprise an integral electrical conductor.

3. Apparatus as in claim 2 wherein the other conductor includes one of said torsion beam members as part of an integral electrical conductor.

4. Apparatus as in claim 3 wherein the portions of the integral electrical conductors which make and break said electrical contact are complementary in shape and disposed to define two parallel mated wiping contact areas which effect a sliding or wiping type of electrical contact.

5. Apparatus as in claim 2 wherein said integral electrical conductor comprises:

a secured leg portion having an axis which is substantially fixed, a torsion beam leg portion having an axis disposed at an effective angle with respect to said secured leg portion and connected thereto at a first end such that rotational forces applied at a point spaced therefrom will tend to cause a twisting of the torsion beam portion along its axis, and an electrical contact leg portion comprising said operating beam and said at least one conductor, said contact leg portion being connected to the other end of the torsion beam leg portion and disposed such that displacement thereof causes rotation of said torsion beam leg portion and consequent making or breaking of said electrical contact.

6. Apparatus as in claim 5 wherein said electrical contact leg portion includes:

a first section having an axis disposed at substantially 90° with respect to the axis of the torsion beam leg portion, and a second section having an axis disposed substantially parallel to the axis of the torsion beam leg portion.

7. Apparatus as in claim 6 wherein the other conductor also includes one of said torsion beam members as part of an integral electrical conductor and wherein the contact leg portions are diposed relative to one another such that the first and second sections of one come into and out of wiping electrical contact with the second and first sections respectively of the other electrical contact leg portion upon displacement of the operating beams.

8. An electrical switch comprising:

an electrically insulating base member having a bottom wall and guide means, an electrically insulating activation member having a top wall and guide means mating with the guide means of said base member to permit relative to-and-from movement of said base and activation members, mating catch means formed in said base and activation members to limit the relative movement therebetween to a maximum amount, a torsion beam spring means having a beam axis disposed to bias said base and activation members to a predetermined limit of relative movement therebetween and to permit movement away from said predetermined limit only through the forced rotation of said torsion beam about its axis, and at least two electrically conducting contact members disposed between said base and activation members for controlling an external electrical circuit contact by relative movement of said base and activation members.

9. An electrical switch as in claim 8 wherein said beam spring means and at least one of said electrically conducting contact members comprise a single unitary electrical conductor having a torsion beam portion formed at an effective angle with respect to a contact area portion.

10. An electrical switch as in claim 9 wherein said effective angle is substantially 90°.

11. An electrical switch as in claim 8 wherein said torsion beam spring means and said electrically conducting contact members comprise two separate but individually integral electrical conductors and wherein each of the electrical conductors is formed to define a plurality of serially connected leg portions comprising:

a secured leg portion having an axis which is substantially fixed with respect to one of said base and activation members, a torsion beam leg portion having an axis disposed at an effective angle with respect to said secured leg portion and connected thereto at a first end such that rotational forces applied to the other end of said torsion beam leg portion will tend to cause a twisting of the torsion beam leg portion along its axis, an electrical contact leg portion having an axis disposed at an effective angle with respect to said torsion beam leg portion, said electrical contact leg portion being connected to said other end of the torsion beam leg portion and disposed such that relative movement of said base and activation members away from said predetermined limit causes displacement of said electrical contact leg portion and, in turn, rotation of said torsion beam leg portion about its axis, and each of said electrical contact leg portions being shaped and disposed to come into and out of wiping electrical contact with the other upon relative movement of said base and activation members.

12. An electrical switch as in claim 11 wherein each of said electrical contact leg portions includes:

a first section having an axis disposed at substantially 90° with respect to the axis of its connected torsion beam leg portion, and a second section having an axis disposed substantially parallel to the axis of its corresponding torsion beam leg portion, said electrical contact leg portions being disposed relative to one another such that the first and second sections of one come into and out of wiping electrical contact with the second and first sections respectively of the other electrical contact leg portion upon relative movement of said base and activation members.

13. An electrical switch as in claim 11 wherein said secured leg portions include sections extending beyond said one of said base and activation members for electrical connection to said external electrical circuit.

14. An electrical switch as in claim 11 wherein said one of said base and activation members is the base member and wherein said base member comprises:

a plurality of side walls extending upwardly from the periphery of the bottom wall and securing means located therewithin at opposingly situated side walls for retaining the secured leg portion of the respectively corresponding contact member.

15. An electrical switch as in claim 12 wherein one of said base and activation members includes an internally directed projection disposed between the first and second sections of the two contact leg portions for maintaining alignment therebetween.

16. An electrical switch structure comprising:

a base member, an activation member movingly mated to and overlying at least a portion of said base member and adapted for movement toward said base member to a minimum limit and movement away from said base member to a maximum limit, and first and second electrical contact members disposed between said base member and said activation member for controlling an external electrical circuit when placed into and out of mutual electrical contact by movement of said activation member toward said minimum limit and toward said maximum limit, at least one of said contact members comprising a torsion beam having an axis therealong and mounted to bias said activation member toward one of said limits and to permit movement toward the other of said limits only through rotation of said torsion beam about its axis.

17. An electrical switch structure as in claim 16 wherein said at least one contact member comprises an integral electrical conductor formed into a first portion comprising said torsion beam and a second portion comprising an electrical contact area disposed to electrically contact the remaining contact member upon movement of said activation member toward said minimum limit.

18. An electrical switch structure as in claim 16 wherein each of said contact members comprise an integral electrical conductor formed into a first portion comprising said torsion beam and a second portion comprising an electrical contact area disposed to make wiping mutual contact with the other mating electrical contact area upon movement of said activation member toward said minimum limit.

19. An electrical switch structure as in claim 18 wherein each of said contact members comprise:

a first leg secured to said base member, a second leg disposed at an angle to said first leg and constituting said torsion beam, a third leg which, in the quiescent state, normally extends angularly between said base member apart and said activation member thereby biasing these members apart and which transmits a rotational force to said second leg when said base member and said activation member are moved toward said minimum limit, and a fourth leg disposed at an angle to said third leg, said third and fourth legs constituting said electrical contact areas such that the fourth and third legs of the first contact member come into wiping electrical contact with the third and fourth legs respectively of the second contact member when said activation member is moved toward said minimum limit.

20. An electrical switch structure as in claim 19 wherein said base member comprises a pair of recesses disposed at an angle with respect to respectively associated second legs and wherein first legs each comprise:

a first section extending outwardly from said base member for connection to an external electrical circuit, and a second section physically secured within the corresponding recess formed in said base member.

21. An electrical switch structure as in claim 20 wherein each of said recesses in the base member comprises a resilient receiving slot having a lower receiving chamber for receiving said second section therein and an upper overlying catch means which is shaped to hold the second section within said receiving chamber after the second section is pushed therebeneath.

22. An electrical switch structure as in claim 16 wherein:

said base member comprises a bottom wall, and a plurality of side walls extending upwardly from the periphery of the bottom wall and vertical guide means included in the outer surface of at least one of said side walls, and said activation member comprises a top wall and a plurality of side walls extending downwardly from the periphery of the top wall about the outside of the corresponding side walls of said base member and vertical guide means included on the inside of at least one of the side walls of said activation member adapted to cooperate with the guide means of said base member to maintain alignment of the base member and activation member during relative movement therebetween.

23. An electrical switch structure as in claim 22 wherein:

the guide means of said base member comprises an outwardly directed projection and the guide means of said activation member comprises an outwardly directed recess which mates with said projection.

24. An electrical switch structure as in claim 23 comprising a plurality of such mating guide means wherein at least one mating guide means is of dimensions different from others thereby insuring proper mating orientation of the base and activation members during assembly.

25. An electrical switch structure as in claim 16 further comprising a vertical projection attached to one of said base and activation members and extending in alignment with said at least one contact member for maintaining the alignment of said contact member during relative movement of said base and activation members.

26. an electrical switch structure as in claim 16 wherein said base and activation members are formed of a resilient insulating material and further comprising:

a least one mating recess and wedge-shaped catch means formed in the base and activation members to define said maximum limit of movement in an assembled condition and formed to permit easy assembly of the base and activation members by relative sliding movement which temporarily deforms the members as the wedge-shaped catch means slides into its mating recess thereafter retaining the members in the assembled condition.

27. Apparatus for making or breaking electrical contact in an electrical circuit, comprising a torsion beam, a pair of torque-applying members for applying a torque to the torsion beam, a first conductor which moves with a first of the torque-applying members and a second conductor disposed for making or breaking electrical contact with the first conductor upon displacement of the first torque-applying member relative to the second torque-applying member in a direction which produces a torsional bias force in the torsion beam resisting the displacement.

28. Apparatus according to claim 27, in which the second torque-applying member is fixed.

29. Apparatus according to claim 27 in which the first conductor, the first torque-applying member and the torsion beam are formed as an integral electrical conductor.

30. Apparatus according to claim 29 in which the first conductor, the first and second torque-applying members, and the torsion beam are formed as an integral electrical conductor.

31. Apparatus according to claim 27 further comprising a second torsion beam and a second pair of torque-applying members for applying a torque to the second torsion beam, the second conductor being movable with a first of the second pair of torque-applying members in such a manner that electrical contact with the first conductor is made or broken upon simultaneous displacement of the first of the second pair of torque-applying members in a direction producing a torsional bias force in the second torsion beam resisting the displacement.

32. Apparatus according to claim 31 in which the second conductor, the second torsion beam and the first of the second pair of torque-applying members are formed as an integral electrical conductor.

33. Apparatus according to claim 31 in which the second of the second pair of torque-applying members is fixed.

34. Apparatus according to claim 33 in which the second conductor, the first and second of the second pair of torque-applying members and the second torsion beam are formed as an integral electrical conductor.

35. Apparatus according to claim 27 in which the portions of the two conductors which make and break the electrical contact are complementary in shape and effect a sliding or wiping type of electrical contact.

36. An electrical switch including apparatus according to claim 27 and further comprising an insulating base having a bottom wall, an actuator having a top wall and guide means mating with corresponding guide means of the base to permit relative movement between the base and the actuator, and mating catch means formed in the base and the actuator to limit the extent of the relative movement, the torque-applying members associated with the, or each, torsion beam being disposed to bias the base and the actuator to a predetermined limit of the relative movement whereby movement away from the predetermined limit is permitted only through displacement of the, or each, torque-applying member to apply a torque to the, or each, torsion beam.

37. A switch according to claim 36 in which the second torque-applying member is fixed and in which each fixed torque-applying member includes a section extending beyond the base of the actuator to provide a switch terminal.

38. A switch according to claim 37 in which the base includes upwardly extending sidewalls and in which the, or each, fixed torque-applying member is secured alongside one of the sidewalls.

39. A switch according to claim 38 in which the two fixed torque-applying members are secured alongside opposed sidewalls.

40. A switch according to claim 36 further comprising a second torsion beam and a second pair of torque-applying members for applying a torque to the second torsion beam, the second conductor being movable with a first of the second pair of torque-applying members in such a manner that electrical contact with the first conductor is made or broken upon simultaneous displacement of the first of the second pair of torque-applying members in a direction producing a torsional bias force in the second torsion beam resisting the displacement in which either base or the actuator includes an internally directed projection disposed between the repsective contacts of the first and second conductors for maintaining alignment therebetween.

41. A switch according to claim 36 further comprising a second torsion beam and a second pair of torque-applying members for applying a torque to the second torsion beam, the second conductor being movable with a first of the second pair of torque-applying members in such a manner that electrical contact with the first conductor is made or broken upon simultaneous displacement of the first of the second pair of torque-applying members in a direction producing a torsional bias force in the second torsion beam resisting the displacement in which the first torque-applying member of each pair includes a first section having an axis disposed at substantially 90° with respect to the axis of the torsion beam to which it is connected and a second section having an axis disposed substantially parallel to the axis of its corresponding torsion beam, the arrangement being such that relative movement between the base and the actuator brings the first and second sections of one of the torque-applying members into and out of wiping electrical contact with the second and first sections respectively of the other torque-applying member.

42. A switch according to claim 39 in which each of the two fixed torque-applying members is secured in a respective recess in the base.

43. A switch according to claim 42 in which each of the recesses comprises a resilient slot having a lower receiving chamber for receiving the respective torque-applying member and an upper overlying catch which is shaped to hold the torque-applying member within the receiving chamber after the torque-applying member is pushed beneath the catch.

44. A switch according to claim 36 in which the guide means of the base comprises an outwardly directed projection and the guide means of the actuator comprises an outwardly directed recess which mates with the projection.

45. A switch according to claim 44 comprising a plurality of the mating guide means in which at least one mating guide means is of dimensions different from the other mating guide means to ensure a correct orientation of the base and actuator during assembly of the switch.

46. A switch according to claim 36 in which the mating catch means comprises at least one mating recess and wedge-shaped catch formed in the base and actuator, the base and the actuator being formed of a resilient insulating material which is temporarily deformed as the wedge-shaped catch slides into its mating recess.

* * * * *